US005198602A

United States Patent [19]

Roper

[11] Patent Number: 5,198,602

[45] Date of Patent: Mar. 30, 1993

[54] SOUND BAR FOR PERCUSSIVE MUSICAL INSTRUMENT

[76] Inventor: Daleth F. Roper, 418 W. Evergreen Ave., Monrovia, Calif. 91016

[21] Appl. No.: 806,092

[22] Filed: Dec. 9, 1991

[51] Int. Cl.[5] ..... G10D 13/08

[52] U.S. Cl. ..... 84/403; 84/408; D17/23

[58] Field of Search ..... 84/403, 408, 404, 405; D17/22, 23

[56] References Cited

U.S. PATENT DOCUMENTS 1,304,435 5/1919 Rhodes ..... 84/403

4,411,187 10/1983 Roper et al. ..... 84/403 X

*Primary Examiner*—Michael L. Gellner

*Assistant Examiner*—P. I. Stanzione

*Attorney, Agent, or Firm*—Wagner & Middlebrook

[57] ABSTRACT

The sound bars of marimbas and the like are provided with one or more independently tuneable vibrattle tongues extending under the tuning arches of such bars for producing one or more different tonal effects.

8 Claims, 1 Drawing Sheet

FIG. 1
PRIOR ART
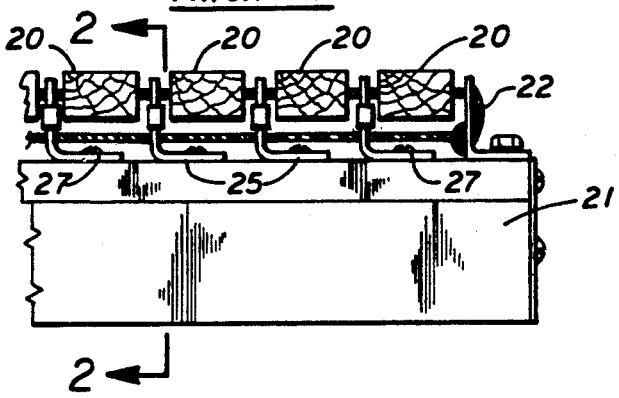
FIG. 2
PRIOR ART
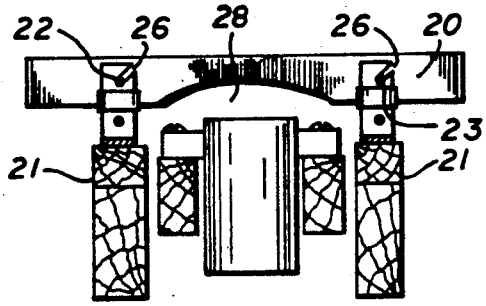
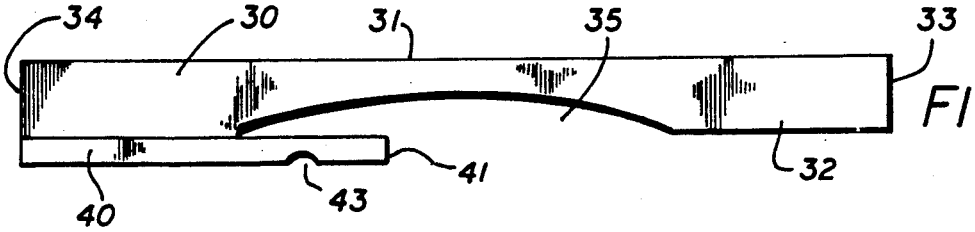
FIG. 3
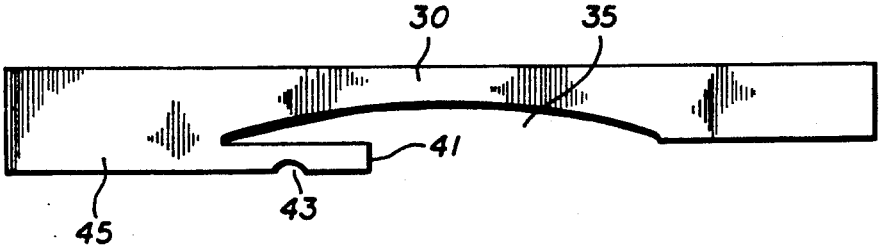
FIG. 4
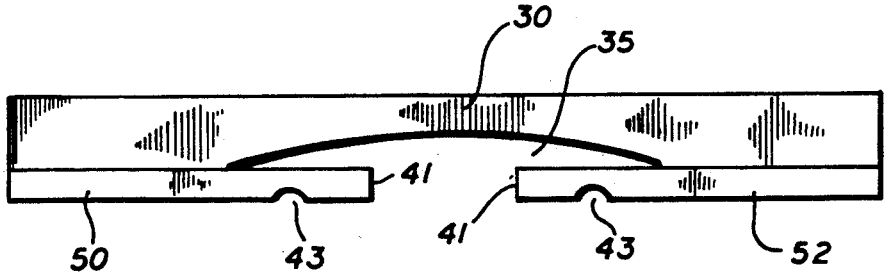
FIG. 5
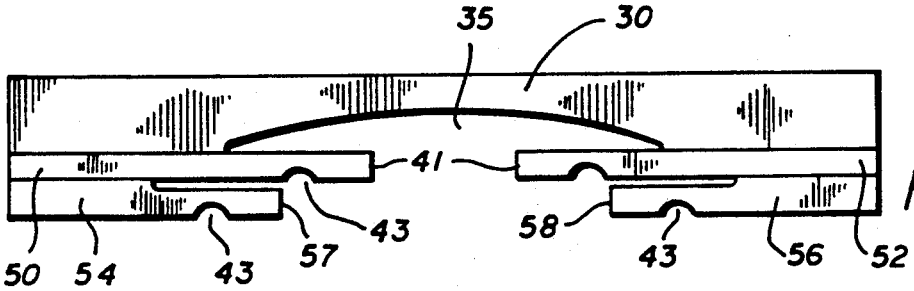
FIG. 6

SOUND BAR FOR PERCUSSIVE MUSICAL INSTRUMENT

BACKGROUND OF THE INVENTION

The present invention relates to improvements in sound bars for percussive musical instruments such as xylophones, marimbas and the like.

Musical instruments of the kind to which the present invention relates usually comprise, an array of sound bars disposed in a piano keyboard arrangement and tuned to a corresponding musical scale so that when struck by mallets they will emit tones corresponding to the musical scale. Modification, tuning and/or prolongation of the tonal emissions has been effected, in a variety of ways as described in *The Book of the Marimba* by Frank K. MacCallum published in 1969 by the Canton Press, N.Y. including, for example, by disposing tuned resonators tubes adjacent each sound bar as described in the U.S. Winterhoff Pat. No. 1,304,435 issued May 20, 1919. While such resonators are effective in the lower octaves, they are not sufficiently effective in the upper portions. The U.S. Roper Pat. No. 4,411,187 discloses control of the decay period of tones emitted by such sound bars in the higher notes as well as the lower, by fabricating such bars of different materials.

A need has existed for a sound bar for such instruments which cannot only produce a desired decay period of the emitted tone but which also can be adapted or adjusted so as to produce one or more of a variety of musical effects, for example, one capable of producing, in addition to a fundamental pitch, other tones such as missing harmonics, or beat frequencies giving a vibrato effect.

BRIEF DESCRIPTION OF THE INVENTION

The present invention meets these needs by providing each of the sound bars of a marimba or similar instrument with one or more tongues which may be formed integrally with the bar or attached thereto, which vibrate when the bar to which they are connected is struck and which may be tuned to a pitch in relation to that to which the sound bar is tuned which will produce one or more of a variety of tonal effects. For example, if the tongue is tuned to a frequency differing from that to which the sound bar is tuned by only a few cycles per second, a beat frequency giving a vibrato effect will be produced when the sound bar is struck, or if the tongue is tuned to a pitch an octave above that of the sound bar, harmonics additional to those produced by the sound bar will be produced when the sound bar is struck and the effect produced is that of two players instead of only one playing the instrument.

BRIEF DESCRIPTION OF THE DRAWING

This invention may be more clearly understood from the following detailed description and by reference to the drawing in which:

FIG. 1 is a view in end elevation of a portion of a marimba keyboard showing the traditional mountings of the sound bars;

FIG. 2 is a view in section of the structure of FIG. 1 taken on the line 2—2 of FIG. 1;

FIG. 3 is a view in side elevation of a sound bar embodying the present invention;

FIG. 4 is a view in side elevation of a modified embodiment of the present invention in which the tongue is formed integrally with the sound bar;

FIG. 5 is a view in side elevation of another modified embodiment of the present invention in which tongues are mounted in tandem on the sound bar; and FIG. 6 is a view in side elevation of still another modified embodiment of the present invention in which tongues are mounted both in tandem and in superimposed relation on the sound bar.

DETAILED DESCRIPTION OF THE INVENTION

Conventionally, as shown in FIGS. 1 and 2, the sound bars 20 of marimbas, xylophones and the like are supported on a frame 21 by cords 22 which pass through holes 23 and 24 in each bar 20 extending transversely thereof at the node positions of the adjacent bars and through upwardly opening slots 26 in support brackets 25 supported on the frame 21 as by bracket screws 27 extending between adjacent bars 20. The under side of each such bar is provided with a tuning arch 28 the dimensions and shape of which may be varied for the purpose of tuning the bar as described in *The Book of the Marimba* referred to above.

As shown in FIG. 3 the sound bar of the present invention comprises a rectangular body 30 which may be fabricated of rosewood, as is conventional in marimbas, or which may be cast of any of various plastics. The body 30 presents an upper, striking face 31, a bottom face 32, and side and end faces 33 and 34 respectively. The bottom face 32 is provided with a conventional tuning arch 35, and the usual holes 23 and 24 for bar support cords 25 which extend through said holes and between the side faces 33.

According to the present invention, the bottom face 32 of the body 30 has secured thereto as by screws, adhesive or the like a tongue 40 which underlies a portion of a tuning arch 43; the vertical portion of brackets 25 being extended sufficiently to maintain the tongue out of contact with the frame 21. Tuning of the tongue 40 is effected, initially, by determining the length of the portion of the tongue 40 which projects under the tuning arch 45, while fine tuning is effected by varying the size and/or shape of the tongue's tuning arch 43 in the manner well known in tuning sound bars.

This basic structure is capable of achieving a variety of results depending upon the tuning of the tongue 40 in relation to that of the body 30. If the tongue is tuned to vibrato at a frequency only a few cycles (cps) different from that to which the body 30 is tuned, a beat frequency giving a vibrate effect is produced when the body 30 is struck. If the tongue is tuned to vibrate at the same frequency as the body of the bar, the duration of the production of the tone following striking of the bar will be significantly extended: an effect of considerable importance especially in the higher registers. If, however, the tongue 40 is tuned to a frequency twice that to which the body 30 is tuned, a harmonic an octave above the tone produced by the body 30 is produced by the tongue 40 when the body is struck; giving the effect of two players instead on one on the instrument.

If, as shown in FIG. 4, a tongue 45, instead of being attached to tone bar body 30, is formed integrally with the body 30, it becomes possible, to achieve all of the effects described in connection with the structure of FIG. 3 except that of extending the audible duration of tone production following striking of the bar by tuning the tongue 45 to the same frequency as the body 30; an effect of importance in the higher registers.

Any desired combination of the effects described above are obtainable according to the present invention by employing a plurality of tongues each tuned to provide an effect different from that provided by the others. As shown in FIG. 5, for example, the body 30 may have secured to it a first tongue 50 extending in one direction under the tuning arch 35 of the body 30, and a second tongue 52 in tandem with the first, extending in the opposite direction under the tuning arch 35; both tongues being provided with tuning arches 43. The first tongue 50 may be tuned to produce any desired effect, while the second tongue 52 may be tuned to produce any other desired effect.

As shown in FIG. 6, the range of audible effects obtainable according to the present invention may be further extended by mounting additional tongues such as are shown at 54 and 56 on the tongues 50 and 52, respectively, in underlying relationship therewith and having free ends 57 and 57 extending under the tuning arch 35 of the body 30 but not as far as the overlying tongues 50 and 52. In this way a wide variety of auditory effects may be obtained.

The above described embodiments of the present invention are descriptive of its principles and are not to be considered limiting. The scope of the present invention instead shall be determined from the scope of the following claims including their equivalents.

What is claimed is:

1. A vibratile tone bar for percussive musical instruments comprising a main portion presenting an upper strike face and having side and bottom surfaces, a vibratile tongue projecting from one of said surfaces and having a free end in spaced relation to said one of said surfaces.

2. A vibratile tone bar according to claim 1 in which said vibratile tongue and said bar are tuned in relation to each other so as to produce an audible beat frequency simulating a vibrato.

3. A vibratile tone bar according to claim 1 in which said one of said surfaces is provided with a tuning arch disposed between the ends of said bar and in which the free end of said tongue is juxtaposed to the cavity of said tuning arch.

4. A vibratile tone bar according to claim 2 in which said vibratile tongue and said bar are tuned in relation to each other so as to produce an audible beat frequency simulating a vibrato.

5. A vibratile tone bar for percussive musical instruments comprising a main portion presenting an upper strike face and side and bottom surfaces, and a plurality of independently tuneable vibratile tongues projecting from at least one said surfaces each having a free end in spaced relation therewith.

6. A vibratile tone bar according to claim 5 in which at least one of said vibratile tongues and said bar are tuned with respect to each other so as to produce a beat frequency simulating a vibrato.

7. A vibratile tone bar according to claim 5 in which one of said surfaces is provided with a tuning arch between its ends and in which the free end of one of said tongues is juxtaposed to the cavity of said tuning arch.

8. A vibratile tone bar according to claim 5 in which one of said surfaces is provided with a tuning arch and in which the free ends of a plurality of said tongues are juxtaposed to the cavity of said tuning arch.

* * * * *